US008096015B2

(12) United States Patent
Smith

(10) Patent No.: US 8,096,015 B2
(45) Date of Patent: Jan. 17, 2012

(54) VACUUM CLEANING NOZZLE

(75) Inventor: James F. Smith, Louisville, OH (US)

(73) Assignee: H-P Products, Inc., Louisville, OH (US)

( * ) Notice: Subject to any disclaimer, the term of this patent is extended or adjusted under 35 U.S.C. 154(b) by 0 days.

(21) Appl. No.: 12/643,161

(22) Filed: Dec. 21, 2009

(65) Prior Publication Data

US 2010/0095478 A1 Apr. 22, 2010

Related U.S. Application Data

(62) Division of application No. 11/228,177, filed on Sep. 16, 2005, now Pat. No. 7,743,463.

(51) Int. Cl.
*A47L 5/10* (2006.01)

(52) U.S. Cl. ..... 15/387; 15/391

(58) Field of Classification Search ..... 15/387, 15/391; *A47L 5/10*

See application file for complete search history.

(56) References Cited

U.S. PATENT DOCUMENTS 1,999,667 A * 4/1935 Smellie ..... 15/346
2,343,227 A * 2/1944 Sellers et al. ..... 15/319
2,525,801 A * 10/1950 Howard ..... 15/337
2,657,417 A * 11/1953 Howard ..... 15/337
4,300,262 A 11/1981 Rodowsky, Jr. et al.
4,766,640 A 8/1988 Martin et al.
4,837,888 A 6/1989 Maier
5,701,633 A 12/1997 Jonischus
6,526,953 B1 3/2003 Inagaki
6,711,777 B2 3/2004 Frederick et al.
6,779,231 B1 8/2004 Stegens et al.
2005/0251953 A1 11/2005 Hackwell et al.

* cited by examiner

*Primary Examiner* — David Redding
(74) *Attorney, Agent, or Firm* — Sand & Sebolt

(57) ABSTRACT

An air-powered vacuum cleaning nozzle has an agitator brush rotated by an air turbine powered by a source of suction air. A plurality of air inlet openings are formed adjacent the agitator brush. A generally flat friction drive belt extends from a bearing shaft of the air turbine to the midpoint of the agitator brush for rotating the brush. The bearing shaft is mounted in a pair of spaced rubber bushings to absorb vibration and reduce noise. The nozzle includes a housing formed by one-piece top and bottom housing members removably joined together securing the air turbine therebetween. A cover plate removably secured to the outside surface of the bottom housing member forms a protective passage for the drive belt and a suction passage between an air inlet adjacent the agitator brush and the air turbine chamber.

8 Claims, 11 Drawing Sheets

VACUUM CLEANING NOZZLE

CROSS REFERENCE TO RELATED APPLICATION

This application is a divisional of U.S. patent application Ser. No. 11/228,177, filed Sep. 16, 2005; the disclosure of which is incorporated herein by reference.

BACKGROUND OF THE INVENTION

1. Technical Field

The invention relates to vacuum cleaning devices and in particular, to the nozzle portion thereof containing an air turbine for rotating an agitator to enhance the cleaning efficiency of the nozzle. Even more particularly, the invention relates to such a vacuum cleaning nozzle in which the air turbine bearing shaft is resiliently mounted to absorb vibration and reduce noise enabling the agitator to be driven by a friction belt.

2. Background Information

Various vacuum cleaning nozzles have been produced which include an air turbine powered by moving air created by a suction which collects the dirt thereby avoiding the use of a separately powered motor for driving an agitator such as a rotary brush mounted at the air inlet end of the nozzle. Heretofore, these air turbine shafts are connected to the rotary brush by a toothed timing belt, which although produces satisfactory results in many cleaning nozzles, increases the noise level of the cleaning nozzle during operation in contrast to a friction drive belt, which provides the desired amount of transfer torque between the air turbine and the agitator but with less noise.

However, it has been found that although the use of a friction drive belt may reduce the noise level of the vacuum cleaning nozzle, it results in unbalanced forces on the agitator brush as well as on the air turbine shaft. Therefore, there is a need for an improved vacuum cleaning nozzle which uses an air turbine that is operatively connected to an agitator by a friction drive belt.

Furthermore, prior vacuum cleaning nozzles having an air turbine contained therein heretofore required a considerable number of parts which must be assembled to encase and protect the air turbine as well as form the air passages from a front air inlet opening adjacent the agitator to the air turbine and from the air turbine to a wand connector at the rear of the nozzle housing. These multiple components increases the material cost of the nozzle as well as the assembly cost thereof, as well as resulting in possible additional maintenance problems.

Another problem known to exist in certain vacuum cleaning nozzles is that the wand attachment between the wand and wand connector at the rear of the nozzle housing requires excessive manipulation either by hand or by depressing an external lever or tab by an operator's foot. These prior art foot-operated latches usually extend outwardly from the sides of the wand connector requiring either a right or left-footed operation which increase the difficulty of detaching the wand from the wand connector.

Still another shortcoming of many prior art vacuum cleaning nozzles is to provide an inexpensive, efficient and convenient manner of attaching the rotary agitator brush to the nozzle housing adjacent the front air inlet opening of the nozzle. Heretofore, the agitator brush is connected with various types of clamps or fasteners, again requiring additional components and manipulative steps for attaching and detaching the agitator brush from the nozzle.

Still another shortcoming of some known nozzle constructions is the forming of the various nozzle components of lightweight rugged plastic, which although provides for a strong and durable nozzle housing, does not provide sufficient weight thereto to enable the nozzle to maintain a firm cleaning contact when moving over the flooring, thereby lessening the cleaning efficiency of the nozzle. In order to increase the weight of the nozzle to a desired weight to provide the desired pressure against the floor being cleaned requires increasing the thickness of the housing or by increasing the weight of the various components incorporated therein, increasing the overall cost of the cleaning nozzle.

Therefore, it is desirable in the nozzle cleaning art to use a friction drive belt for connecting an air driven turbine to the agitator, yet which will reduce the vibration and noise than that possible with heretofore used timing drive belts. Furthermore, the cleaning nozzle should have a certain weight without increasing the cost and have a wand release attachment device easy to operate, and provide a convenient and inexpensive manner to removably mount the agitator adjacent the air inlet end of the nozzle.

These features are obtained by the improved vacuum cleaning nozzle of the present invention as described further below.

BRIEF SUMMARY OF THE INVENTION

One aspect of the present invention is to provide a rugged, pleasingly attractive cleaning nozzle which utilizes a friction drive belt for connecting an air turbine to an agitator to reduce noise and vibration than heretofore possible with friction drive or toothed timing belts.

Another aspect of the present invention is to provide for an improved wand release latch which can be easily operated by the user's foot by positioning a latching tab which extends outwardly and along a rear portion of the wand thereby providing a guide along which the user's foot may slide for contacting the latch to release the wand from the cleaning nozzle.

Still another feature of the present invention is to enable at least one or more weights to be placed conveniently within the nozzle housing in a resilient mount to avoid or materially reduce vibration, to enable the nozzle to have a variety of desired weights to provide enhanced cleaning efficiency by maintaining a desired amount of pressure contact with the cleaning surface in a relatively simple and efficient manner.

A further aspect of the present invention is to provide for a slip-fit mounting arrangement at the bearing ends of a rotatably mounted agitator which enables the agitator to be positioned adjacent the air inlet opening at the front end of the nozzle housing and be retained therein upon attachment of an agitator cover plate, eliminating the need for additional attachment brackets and fasteners to secure the agitator within the end of the nozzle housing.

Another aspect of the invention is to provide a simple, effective and convenient manner of attaching the main support wheels for the nozzle on the nozzle housing by a slip-fit engagement of a wheel attachment bracket in a slotted wall opening in each of the side walls of the housing.

The foregoing advantages, construction and operation of the present invention will become more readily apparent from the following description and accompanying drawings.

BRIEF DESCRIPTION OF THE SEVERAL VIEWS OF THE DRAWINGS

A preferred embodiment of the invention, illustrative of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
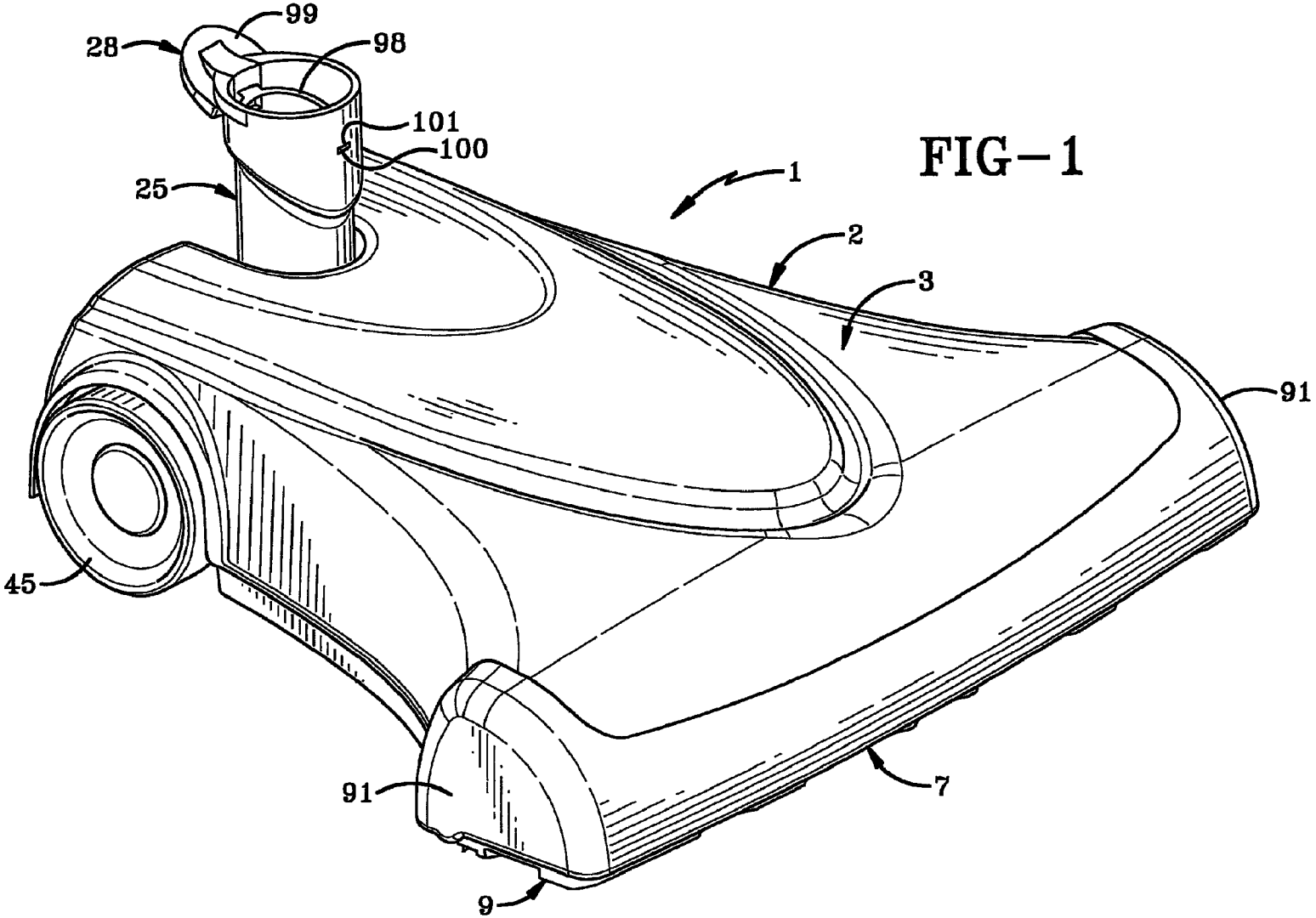
FIG. 1 is a perspective view of the vacuum cleaning nozzle of the present invention.
Figure 2:
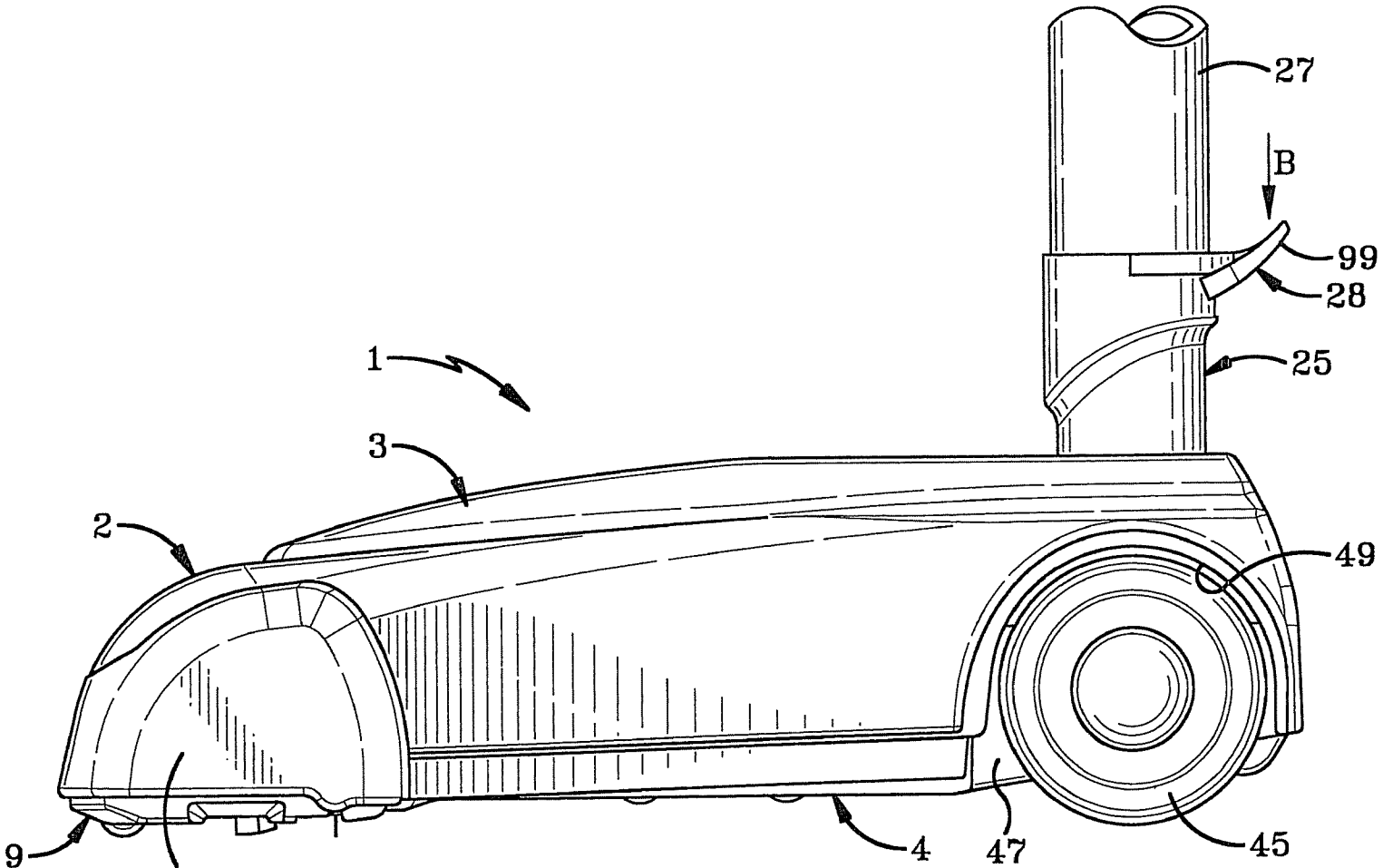
FIG. 2 is a side elevational view of the cleaning nozzle of FIG. 1.

The improved suction cleaning nozzle of the present invention is indicated generally at 1, and is shown in assembled position in FIGS. 1 and 2. Nozzle 1 includes a main housing 2 formed by a top housing member 3 and a bottom housing member 4 which are secured in an assembled position by a plurality of screws 5. Housing members 3 and 4 preferably are formed of rugged lightweight plastic materials with top housing member 3 being formed in various pleasingly attractive colors to enhance the attractiveness of the assembled vacuum cleaning nozzle.

A usual main air inlet opening 7 is formed laterally across the front of the air nozzle between top and bottom housing members 3 and 4, and is defined by an agitator cover plate 9 (FIG. 3) which forms a plurality of air inlet openings 10 through which the cleaning air and dust and dirt particles are drawn by a suction force created by a remote vacuum source and facilitated by an agitator 15 rotated by an air turbine indicated generally at 11. The agitator preferably is a roller brush 15 and is rotatably mounted adjacent inlet opening 7 by a pair of end bearings (not shown) which are mounted in the ends of the agitator roller for rotatably mounting the agitator in opening 7. Agitator 15 usually will have a plurality of bristles 18 to increase the cleaning efficiency of the vacuum cleaning nozzle.

Figure 5:
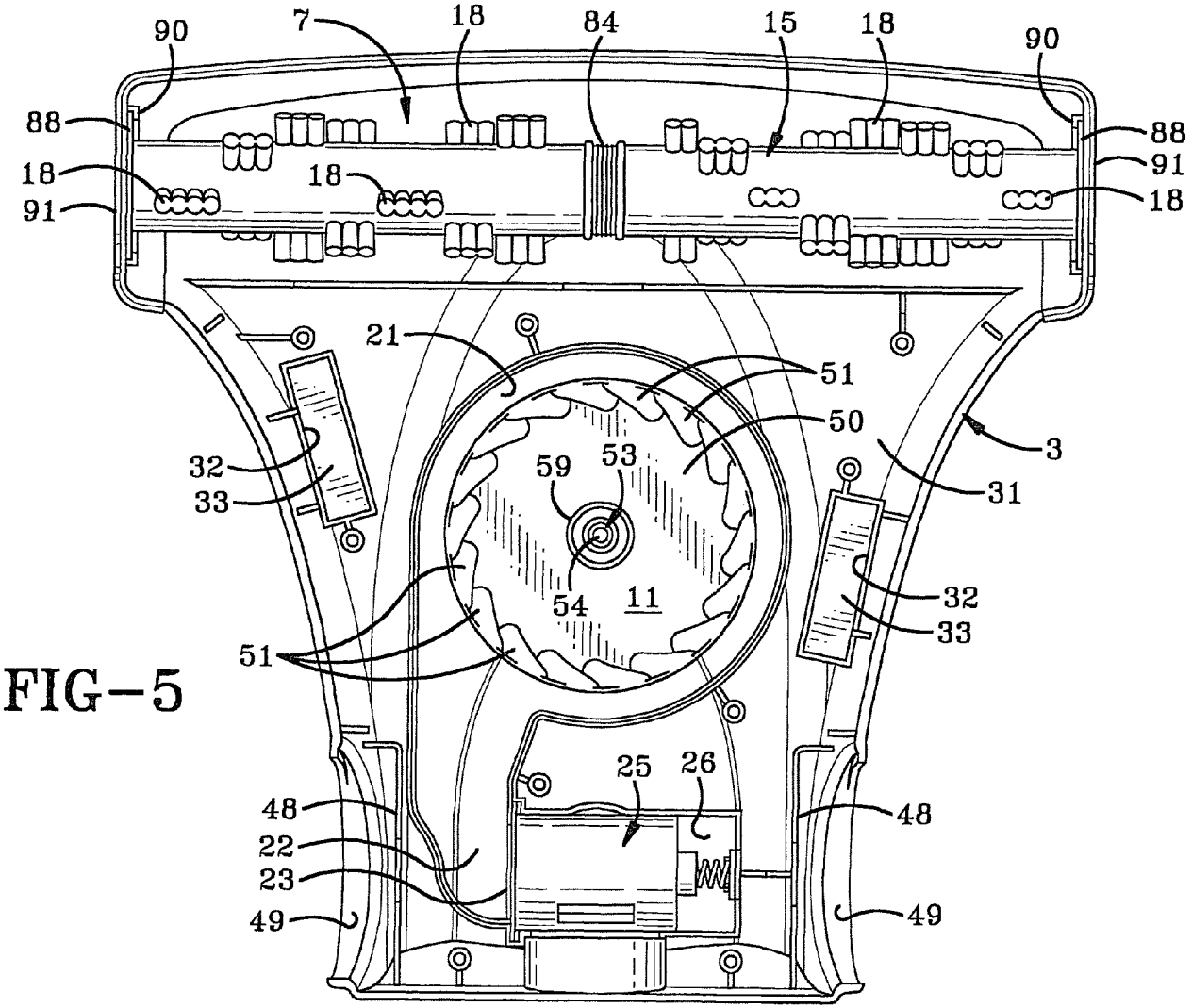
FIG. 5 is a bottom plan view similar to FIG. 4 of the top housing member of the nozzle with the bottom housing member being removed therefrom.

A bottom plan view of the inside surface and interior of top housing member 3 is shown in FIG. 5. Member 3 includes a generally annular-shaped chamber 21 in which air turbine 11 is rotatably mounted. A rearwardly extending air suction passage 22 communicates with chamber 21 and with the open end 23 of a pivotally mounted wand connector 25. Wand connector 25 is pivotally mounted in a rectangular-shaped compartment 26 formed at the rear of top housing member 3 and is adapted to be connected to a cleaning wand 27 (FIG. 11) by an improved latch mechanism 28 described further below.

Figure 6:
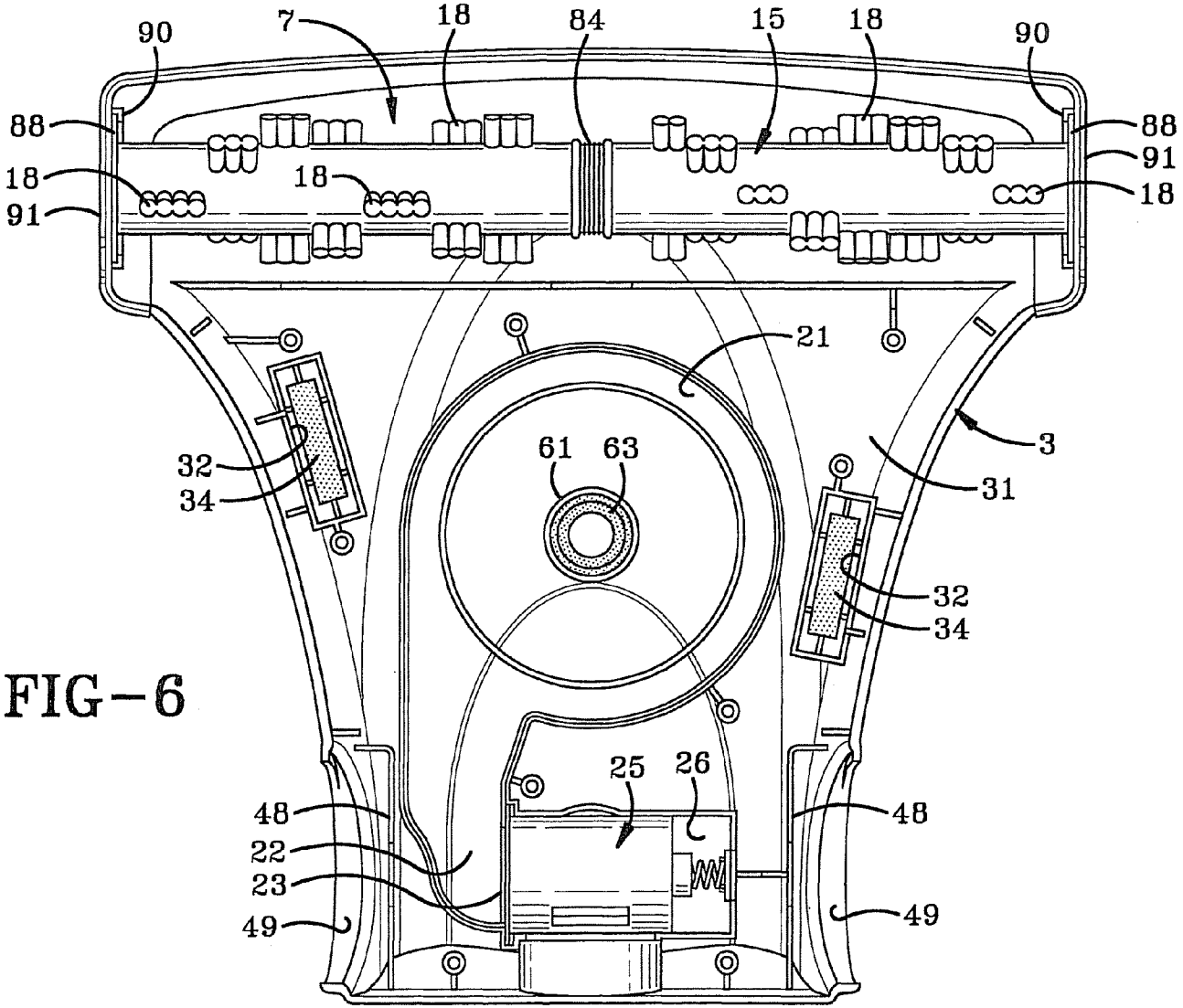
FIG. 6 is a view similar to FIG. 5 with the air turbine and side weights being removed therefrom.
Figure 13:
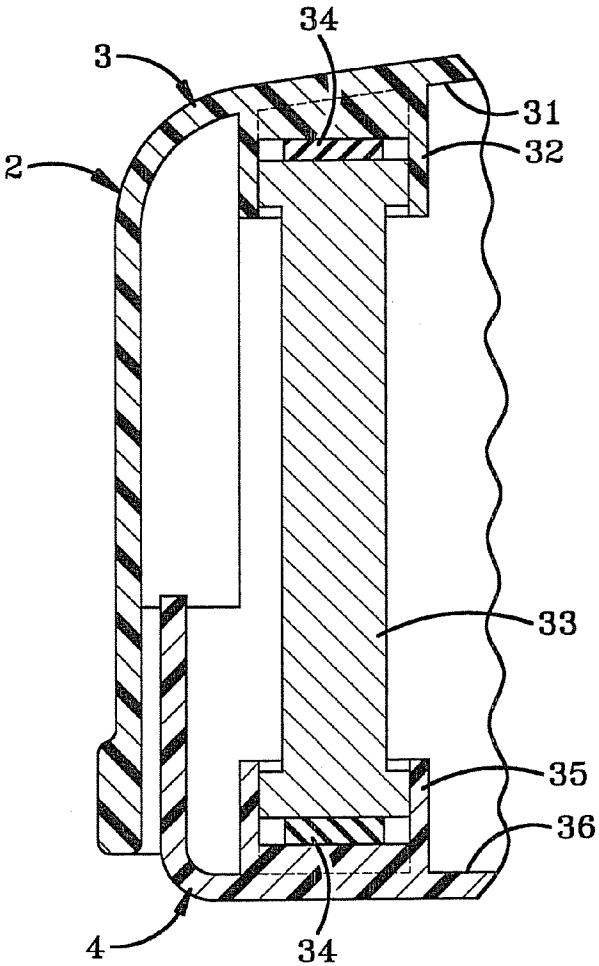
FIG. 13 is an enlarged fragmentary sectional view of one of the nozzle weights trapped between the top and bottom housing member when in an assembled position.

In accordance with a feature of the present invention, a pair of rectangular-shaped pockets 32 are formed on the inside surface 31 of top housing member 3 (FIG. 5) adjacent the housing member side walls in which is mounted a pair of rectangular-shaped weights 33 (FIG. 13). Weights 33 provide increased weight to the cleaning nozzle to provide sufficient pressure against a surface being cleaned to increase the cleaning efficiency thereof. As shown in FIGS. 6 and 13, rubber pads 34 are placed in the bottom of pockets 32 for resiliently supporting weights 33 therein. A similar pair of rectangular-shaped pockets 35 are formed on the inside surface 36 of bottom housing member 4 (FIG. 7) and contain similar rubber pads 34. These pads and pockets trap weights 33 between the top and bottom housing members when in an assembled position to resiliently mount the weights to prevent vibration and noise being produced thereby. Weights 33 enable any desired weight to be achieved for the air cleaning nozzle enabling the housing members and internal components to be produced as inexpensively and lightweight as possible, yet provide the desired amount of weight to the cleaning nozzle in a simple and efficient manner by choosing a particular size and weight for placement in pockets 32 and 35.

Figure 7:
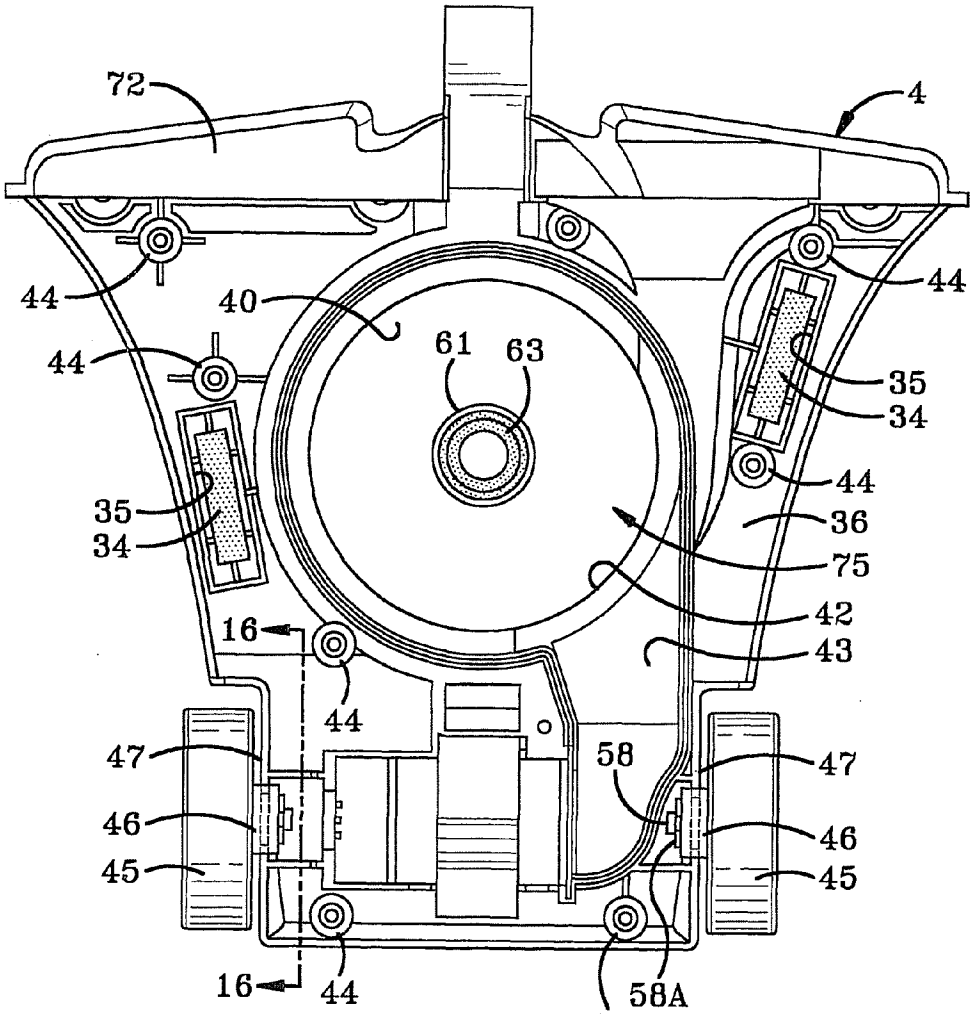
FIG. 7 is an inside plan view of the nozzle bottom housing member removed from the top housing member.
Figure 8:
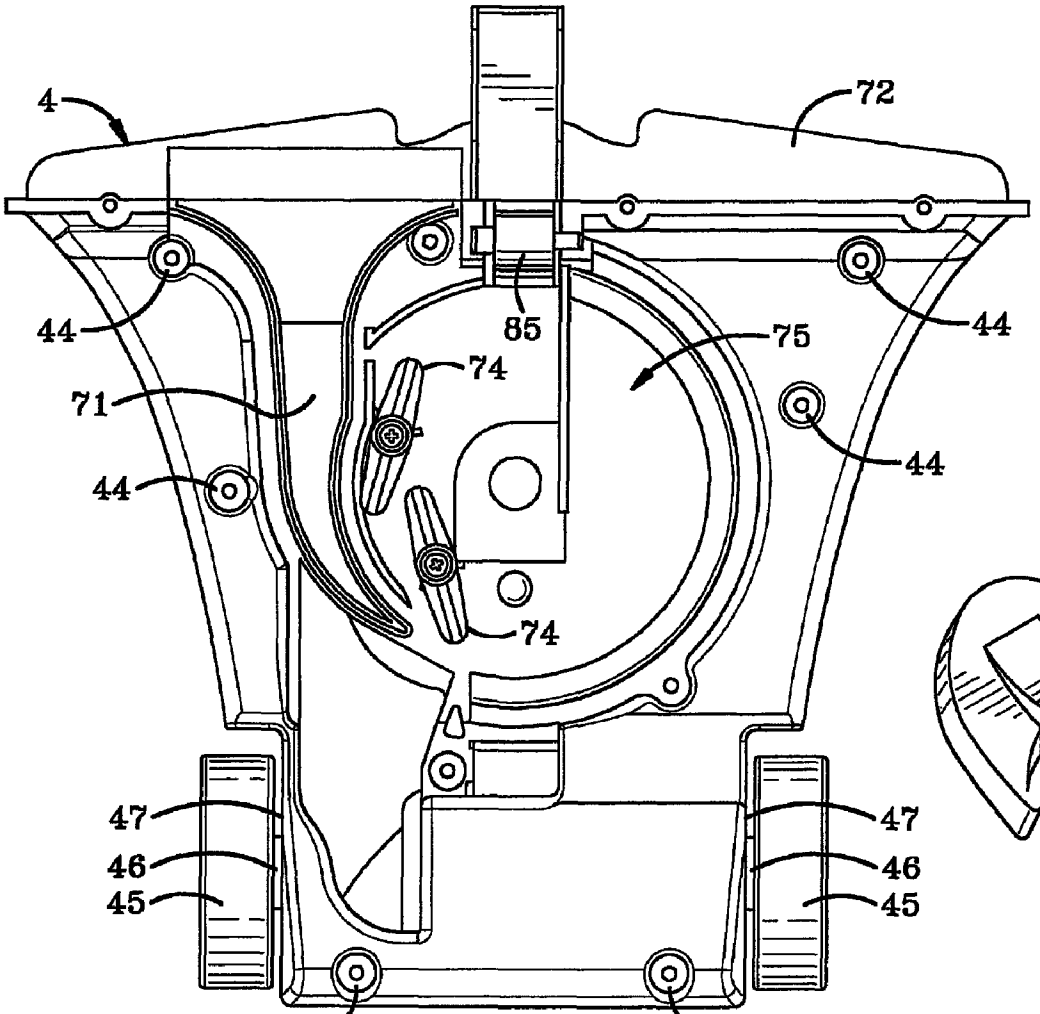
FIG. 8 is an outside plan view of the bottom housing member of FIG. 7 removed from the top housing member.

Bottom housing member 4 best shown in FIGS. 7 and 8, is also formed with a generally annular-shaped internal chamber 40, which when in an assembled position with top housing member 3, aligns with chamber 21 for receiving and trapping air turbine 11 therein. An arcuate air passage 42 is formed in and extends along an arcuate portion of chamber 40 and communicates with the air turbine chamber and with a rearwardly extending air passage 43 which aligns with air passage 22 in top housing 3 and communicates with wand connector 25. A plurality of hollow upstanding bosses 44 are formed integrally on bottom housing member 4 and projects outwardly therefrom for receiving fastening screws 5 therethrough for securing the two housing members together in an assembled position.

Figure 16:
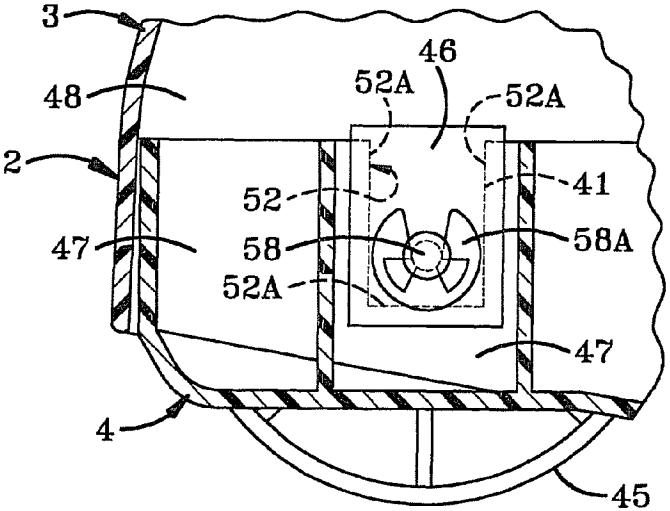
FIG. 16 is an enlarged fragmentary sectional view looking in the direction of Arrow 16-16, FIG. 7.

In accordance with another feature of the invention, a pair of wheels 45 (FIGS. 7 and 16) are slidably mounted by support brackets or clips 46 on outer side walls 47 of bottom housing member 4 and are trapped thereon by a pair of ribs 48 (FIG. 5) formed on top housing member 3, when member 3 is assembled with member 4. Clips 46 are formed with a pair of grooves 41 extending along opposite sides thereof in which are received edges 41A which form notches 52 in side walls 47 for slidably receiving and retaining clips 46 therein. Wheels 45 are rotatably mounted on clips 46 by stub axles 58 which are retained thereon by spring clips 58A. Ribs 48 are located adjacent arcuate-shaped openings 49 for receiving wheels 45 therein as shown in FIG. 5.

Figure 12:
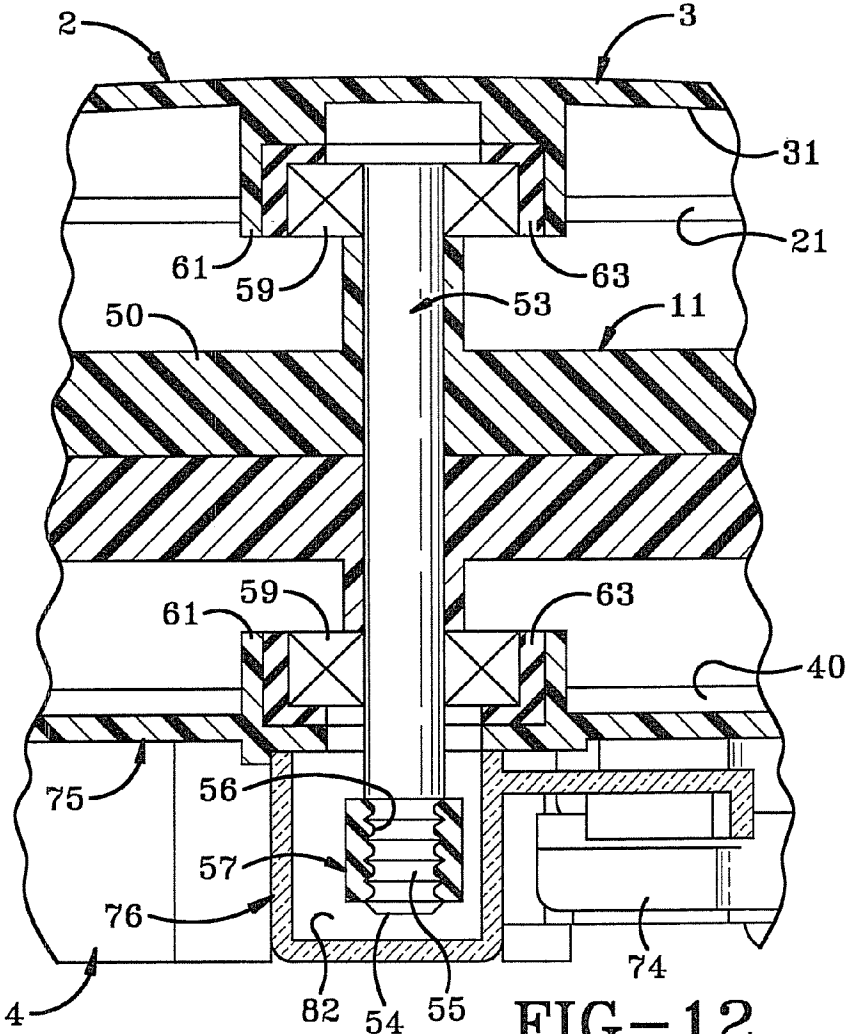
FIG. 12 is an enlarged fragmentary sectional view of the air turbine bearing shaft resiliently mounted between the top and bottom nozzle housing members in an assembled operative position.

Air turbine 11 includes an annular body 50 preferably formed of plastic (FIGS. 5 and 12), having a plurality of outer vanes 51 extending around the outer surface. A bearing shaft 53, is secured to air turbine 11 and includes a drive end 54 which is formed with a series of annular valleys 55 for receiving circumferential ribs 56 formed on the inside surface of a friction drive belt 57. A pair of bearings 59 are mounted on shaft 53 on opposite sides of air turbine body 50 and have usual inner and outer races (not shown) for rotatably mounting shaft 53 in a pair of cup-shaped bearing supports 61. Bearing supports 61 are formed integrally on the inside surfaces of top and bottom housing members 3 and 4, and are in alignment with each other as shown in FIG. 12, when in an assembled position.

Friction drive belt 57 replaces the toothed timing belts heretofore used in vacuum cleaning nozzles for connecting an air turbine to an agitator in order to reduce noise and vibrations heretofore caused by the toothed belt. Furthermore and in accordance with one of the main features of the invention, a generally cup-shaped elastomeric mount 63 is seated in each of the cup-shaped supports 61. As shown in FIG. 12, elastomeric mounts 63 isolate the shaft bearings from the rigid plastic nozzle housing and absorb undesirable noise caused by the rotating air turbine. The use of a friction drive belt to further reduce undesirable noise creates various unbalanced forces on the shaft bearings. Mounts 63 have been found to absorb or materially reduce these unbalanced forces enabling the friction drive belt to perform satisfactorily to reduce the noise and rotate an agitator. As shown in FIG. 12, the cup-shaped configuration of the elastomeric mounts surrounds, as well as supports the shaft bearings in supports 61.

The outside surface of bottom housing member 4 is shown in FIG. 8 and includes a suction passage 71 which communicates with a laterally extending front portion 72 which communicates with the main air inlet opening 7 formed by top housing member 3 when housing member 4 is secured to housing member 3. Air passage 71 communicates with arcuate-shaped air passage 22 to provide for the continuous flow of air together with the collected dirt and dust particles through air inlet opening 7, about the air turbine body, and then out through wand connector 25 and cleaning wand 27 to an appropriate collection receptacle, such as a floor-mounted canister or in-wall vacuum cleaning system.

Figure 3:
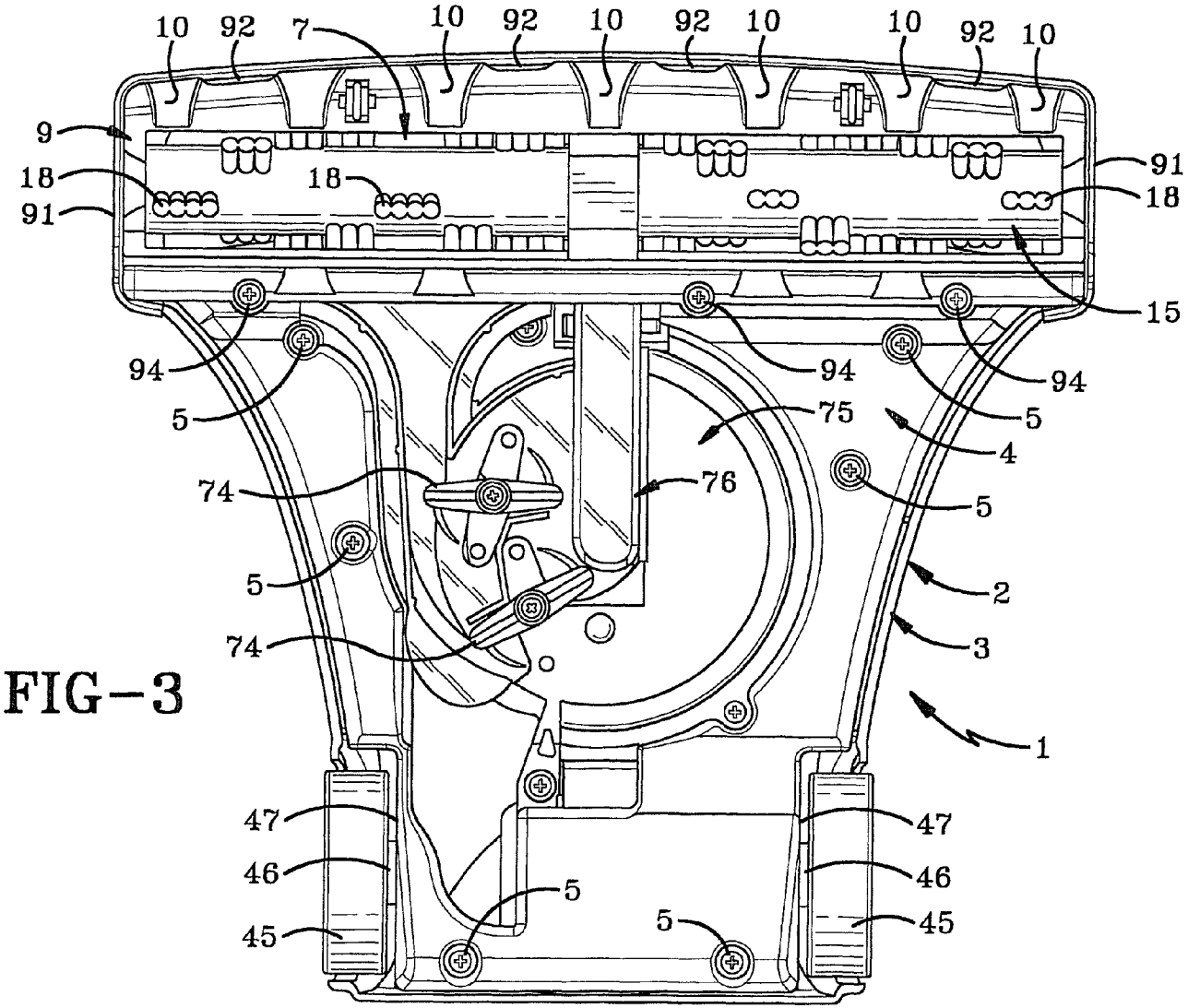
FIG. 3 is a bottom plan view of the assembled nozzle of FIGS. 1 and 2.
Figure 9:
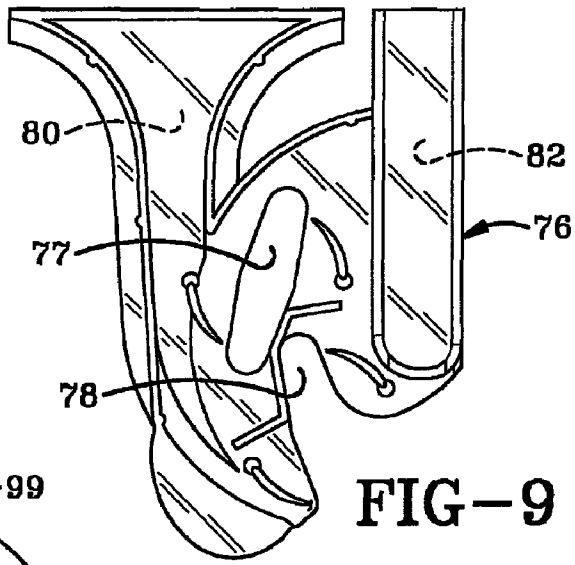
FIG. 9 is a top plan view of the air turbine suction passage and drive belt cover plate removed from the bottom of the cleaning nozzle as shown in FIG. 3.

A pair of rotatable latches 74 (FIGS. 4 and 8) are mounted above an annular housing 75 which forms the internal turbine chamber for securing an air passage and drive belt enclosure plate indicated generally at 76 (FIG. 9), on the outside surface of bottom housing 4. Cover plate 76 preferably is of a one-piece molded plastic construction having an elongated opening 77 and an arcuate slot 78 formed therein for receiving latches 74, afterwhich the latches are rotated to a latched position as shown in FIG. 3 for securing cover plate 76 on bottom housing member 4. Cover plate 76 has a hollow internal passage 80 which aligns with and covers suction passage 71 for containing the flow of air through the nozzle housing until it reaches the air turbine chamber. Cover plate 76 also provides a protective passage 82 through which drive belt 57 extends when moving between drive shaft 53 and a central area 84 of agitator 15.

Figure 4:
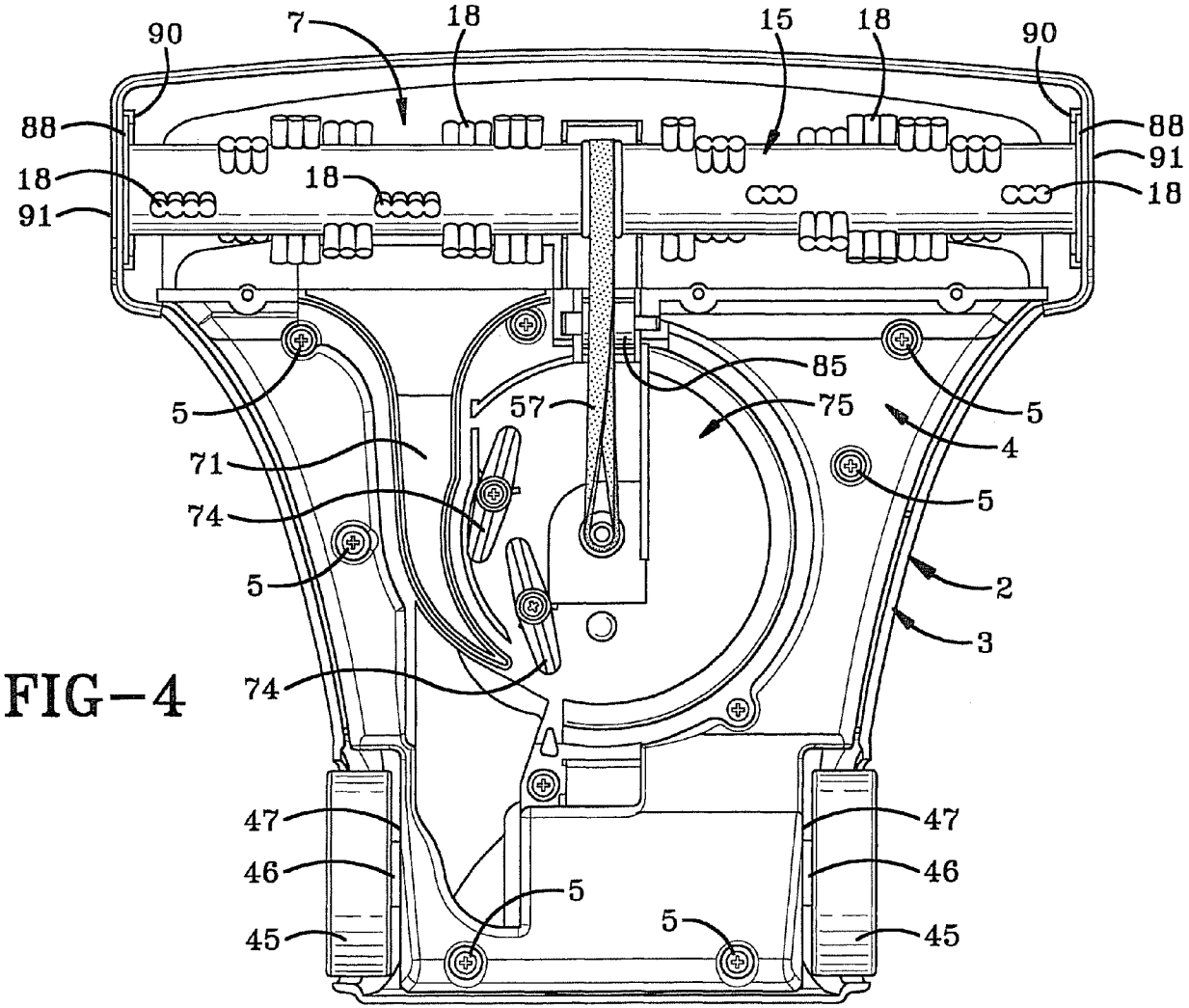
FIG. 4 is a bottom plan view similar to FIG. 3, with the air turbine suction passage and drive belt cover plate being removed therefrom.

As shown in FIG. 4, drive belt 57 preferably moves over an idler roller 85 which assists in maintaining a desired tension on the belt as it moves about the grooved drive end 54 of shaft 53 and about drive area 84 of agitator 15. Drive area 84 preferably is formed with a plurality of annular grooves to provide alignment with the drive belt ribs. Cover plate 76 provides both protection for the drive belt and encloses the suction air passage. Also, plate 76 is easily removed from its attached position on the outer surface of bottom housing member 4 by latches 74 to enable maintenance to be formed easily on the vacuum cleaning nozzle, such as replacing the drive belt, without disassembling the nozzle housing.

Figure 15:
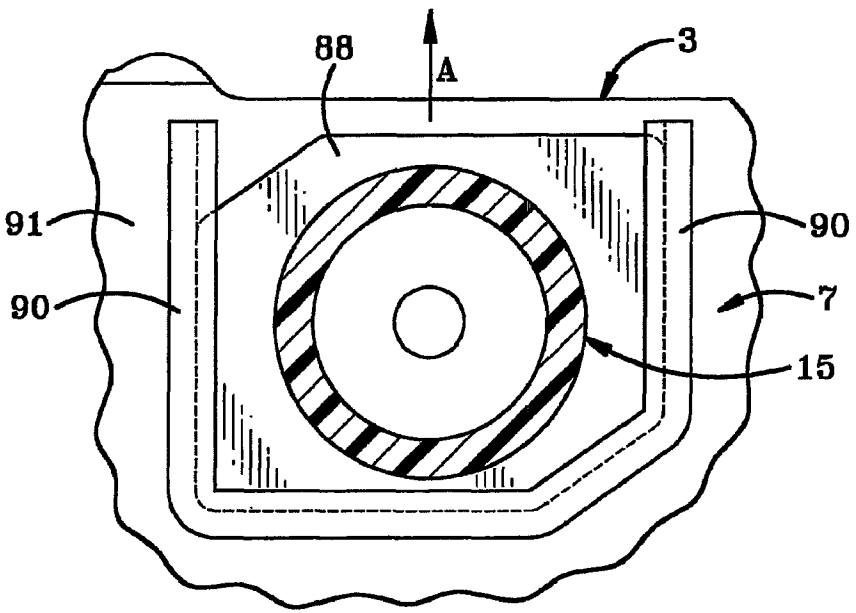
FIG. 15 is a fragmentary sectional view looking in the direction of Arrows 15-15, FIG. 14.
Figure 14:
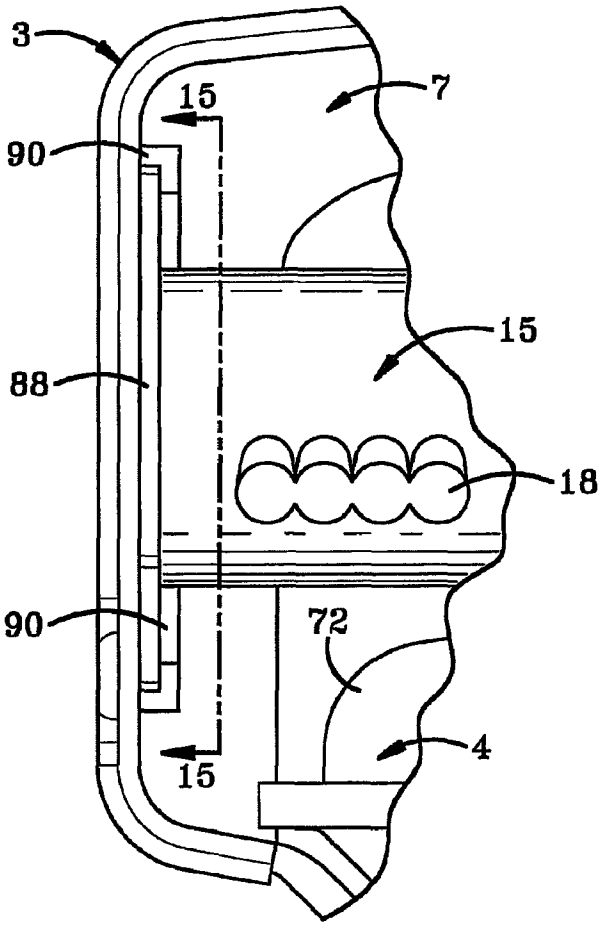
FIG. 14 is a fragmentary plan view of one end of the agitator mounting in the top housing member.

In accordance with another feature of the invention, agitator 15 is conveniently and securely mounted within air inlet opening 7 by a pair of flange plates 88 (FIGS. 14 and 15) which are connected to agitator 15 by the internal bearings. Plates 88 are slidably received in a complementary-shaped brackets 90 which are formed integrally on the inside surfaces of side walls 91 of top housing member 3, which side walls define the ends of air inlet opening 7. Flanges 88 are retained within brackets 90 by air inlet agitator cover plate 9. Plate 9 is secured to top housing member 3 (FIG. 3) by a plurality of front clips 92 and a plurality of rear fasteners 94. Thus, in order to remove agitator 15 for maintenance purposes, fasteners 94 only need be removed enabling plate 9 to be easily removed, afterwhich agitator 15 can be slid upwardly in the direction of Arrow A (FIG. 15), slidably removing flanges 88 from within mounting brackets 90.

Figure 10:
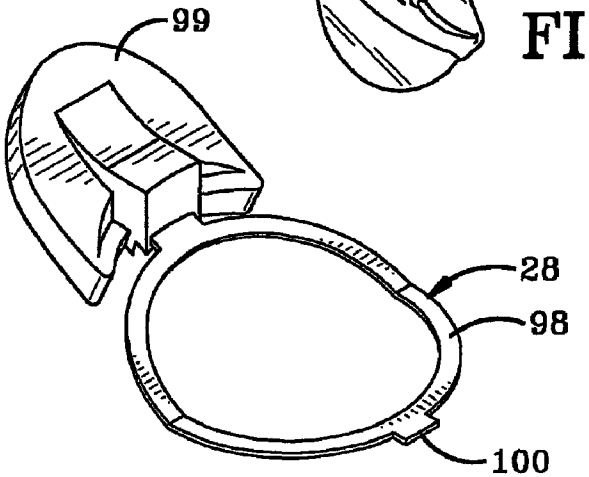
FIG. 10 is a perspective view of the wand attachment latch removed from the cleaning nozzle.
Figure 11:
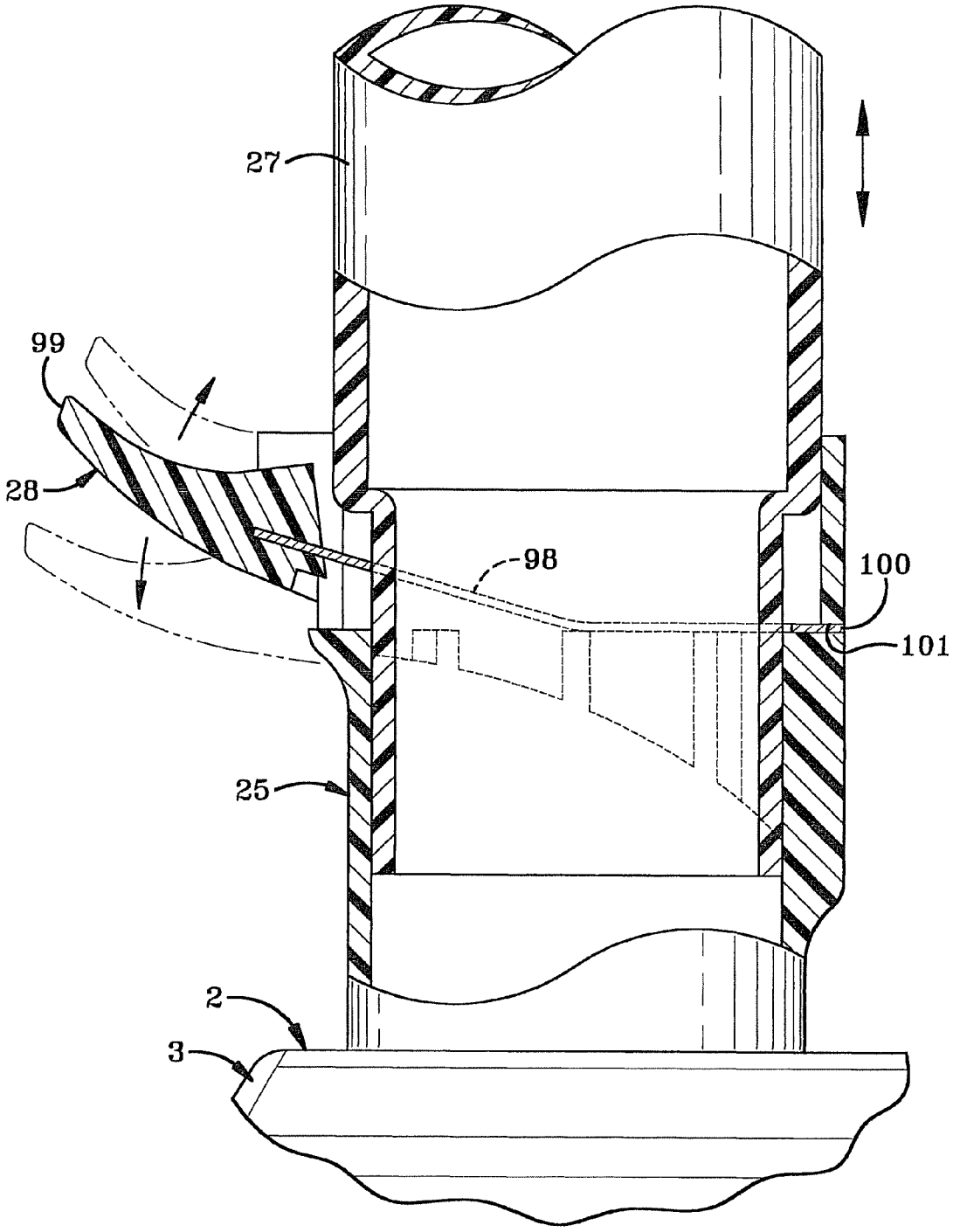
FIG. 11 is an enlarged side elevation with portions broken away and in section, showing the wand attachment latch of FIG. 10 mounted on the wand connector in a latched position with a cleaning wand.

In accordance with still another feature of the invention, improved wand latch mechanism 28 (FIGS. 10 and 11) provides an enhanced means for engaging and disengaging a cleaning wand 27 from the pivotally mounted wand connector 25. Latch mechanism 28 preferably is a two-piece member consisting of a ring-shaped member 98 having an actuation tab 99 bonded thereto. Ring 98 is formed of a spring steel and has a bend therein as shown in FIG. 11, so as to bias tab 99 in an upward direction. Ring 98 also includes a front end projection 100 which extends through an opening 101 found in wand connector 25 to assist in the mounting of ring 98 inside the hollow bore of connector 25. As shown in FIGS. 10 and 11, tab 99 extends outwardly from the back end of the nozzle instead of outwardly to the sides thereof as in many prior wand attachments. This rearward outward extension enables an operator to press downwardly on the tab as shown by Arrow B (FIG. 2), which releases the tab from its locked position with cleaning wand 27 as shown in full line in FIG. 11, enabling the wand to be disengaged easily from connector 25. Ring 98 is biased towards the latched position, and thus will lock automatically upon cleaning wand 27 being slidably inserted into wand connector 25. However, the location of tab 99 extending outwardly from the rear of the cleaning wand enables an operator's foot to move easily along the rear surface of wand 27 as can be visualized in FIG. 2, when actuating tab 99. Also, this can be accomplished by either foot. Where an actuating tab extends outwardly from the sides of the wand connector, it requires either a right or left foot actuation and not actuation by either foot as in the present invention. The location of tab 99 extending outwardly from the rear surface of cleaning wand 27 has been found to permit the operator's foot to slide along the rear of the wand into unlatching engagement with tab 99, thereby increasing the ease of operation of the improved vacuum cleaning nozzle.

Thus, the improved air cleaning nozzle 1 of the present invention has a number of improvements not believed present in existing cleaning nozzles, especially those using an air turbine for creating the driving force for a rotatable agitator. In particular, the elastomeric mounting of the air turbine enables a friction drive belt to be utilized replacing the heretofore tooth belt to provide a reduction in the operating noise level of the nozzle, as well as to absorb any unbalanced forces exerted on the agitator by the use of a friction drive belt. Furthermore, the agitator is easily and conveniently mounted adjacent the air inlet opening by a pair of flanges which are slidably mounted in brackets form integrally with the side wall of the top housing portion of the nozzle and secured therein upon placement of the agitator cover plate on the nozzle by several fasteners. This enables the agitator to be easily removed for maintenance purposes.

The final weight of the nozzle can be controlled easily by selecting various sizes of weights which are resiliently mounted between the top and bottoming housing members in a pair of aligned pockets with a resilient mounting arrangement eliminating any unwanted vibration and noise.

The molded cover plate removable mounted on the bottom surface of the bottom housing forms a protective passage for the drive belt, as well as an enclosure for the suction air passage. This plate can be easily removed by two unlatching tabs to provide access to the drive belt, as well as the suction passage, should any maintenance be required thereon. Likewise, the main support wheels for the nozzle are easily mounted by a slip-fit engagement of a pair of wheel mounting clips in a pair of notches formed in the side walls of the bottom housing to facilitate the mounting of the wheels on the housing as well as any replacement thereof should it become necessary.

Another feature is to form the main nozzle housing of two separately molded pieces which are secured together by a plurality of fasteners such as screws, which entrap the air turbine in an interior chamber, as well as forming the air passages connecting the front air inlet opening in a rear pivotally mounted wand connector. Also, the improved wand latch provides a mechanism enabling the cleaning nozzle operator to easily latch and unlatch a cleaning wand from the wand connector. All of these improved features are obtained relatively inexpensively and with a minimum number of parts thereby lessening the assembly procedures required when fabricating the cleaner nozzle, thereby resulting in a lower cost product.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A vacuum cleaning nozzle comprising:

a housing having a top housing member and a bottom housing member removably secured together;

an air turbine mounted between said top and bottom housing members and having a shaft extending outwardly through said bottom housing member;

an agitator rotatably mounted within the top housing member adjacent a front air inlet opening formed between the top and bottom housing member;

a drive belt extending between the agitator and air turbine shaft for rotating said agitator;

an idler roller mounted on the bottom housing member to assist in maintaining a desired tension on the drive belt; and a cover plate attached to an outside surface of the bottom housing member and forming a protective passage for the drive belt and forming a suction passage between the air turbine and front air inlet opening.

2. The vacuum cleaning nozzle defined in claim 1 wherein the cover plate is a one piece molded plastic component.

3. The vacuum cleaning nozzle defined in claim 1 including a pair of wheels rotatably attached to the bottom housing member, each by a bracket slidably received in a notch formed in the bottom housing member.

4. The vacuum cleaning nozzle defined in claim 3 wherein each wheel includes a stub axle which is retained in the bracket by a spring clip.

5. A vacuum cleaning nozzle comprising:

a housing having a top housing member and a bottom housing member removably secured together;

an air turbine mounted between said top and bottom housing members and having a shaft extending outwardly through said bottom housing member;

an agitator rotatably mounted within the top housing member adjacent a front air inlet opening formed between the top and bottom housing member;

a drive belt extending between the agitator and air turbine shaft for rotating said agitator;

a cover plate attached to an outside surface of the bottom housing member and forming a protective passage for the drive belt and forming a suction passage between the air turbine and front air inlet opening; and wherein said housing includes a generally annular internal chamber containing the air turbine therein; in which a pair of opposed hubs are formed within the chamber; and in which an elastomeric mounting assembly includes a pair of elastomeric support members, each of which is mounted in a respective one of the hubs for rotatably supporting the bearing shaft therein.

6. The vacuum cleaning nozzle defined in claim 5 wherein each of the elastomeric support members has a cup-shaped configuration and is generally complementary to the housing hubs and is seated in said hubs.

7. A vacuum cleaning nozzle comprising:

a housing having a top housing member and a bottom housing member removably secured together;

an air turbine mounted between said top and bottom housing members and having a shaft extending outwardly through said bottom housing member;

an agitator rotatably mounted within the top housing member adjacent a front air inlet opening formed between the top and bottom housing member;

a drive belt extending between the agitator and air turbine shaft for rotating said agitator;

a cover plate attached to an outside surface of the bottom housing member and forming a protective passage for the drive belt and forming a suction passage between the air turbine and front air inlet opening; and wherein at least one elongated slot is formed in the cover plate; and in which at least one elongated latch is rotatably mounted on the bottom housing member and extends through the elongated slot for removably mounting the cover plate on said bottom housing member.

8. The vacuum cleaning nozzle defined in claim 7 wherein a pair of elongated latches are rotatably mounted on the bottom housing member and extend through a pair of elongated slots formed in the cover plate for removably mounting the cover plate on the bottom housing member.

* * * * *